US008299694B2

(12) United States Patent
Suzuki et al.

(10) Patent No.: US 8,299,694 B2
(45) Date of Patent: Oct. 30, 2012

(54) SPARK PLUG HAVING IMPROVED ADHESION BETWEEN RESISTOR AND GLASS SEALING LAYER

(75) Inventors: Akira Suzuki, Nagoya (JP); Tomoaki Kato, Nagoya (JP); Tsutomu Shibata, Owariasahi (JP); Mamoru Musasa, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 148 days.

(21) Appl. No.: 12/734,534

(22) PCT Filed: Mar. 23, 2009

(86) PCT No.: PCT/JP2009/055683

§ 371 (c)(1),
(2), (4) Date: May 7, 2010

(87) PCT Pub. No.: WO2009/122941

PCT Pub. Date: Oct. 8, 2009

(65) Prior Publication Data

US 2010/0264823 A1 Oct. 21, 2010

(30) Foreign Application Priority Data

Mar. 31, 2008 (JP) ..... P2008-090118

(51) Int. Cl.
*H01T 13/20* (2006.01)

(52) U.S. Cl. ..... 313/144; 313/118; 313/135; 313/141; 313/143; 313/145; 123/169 R

(58) Field of Classification Search ..... 313/118, 313/136, 141, 144
See application file for complete search history.

(56) References Cited

U.S. PATENT DOCUMENTS

| | | | | |
|---|---|---|---|---|
| 5,008,584 | A * | 4/1991 | Atsumi et al. | 313/136 |
| 5,565,730 | A * | 10/1996 | Pollner et al. | 313/135 |
| 6,160,342 | A | 12/2000 | Nishikawa et al. | 313/141 |
| 6,188,166 | B1 | 2/2001 | Nishikawa et al. | 313/141 |
| 6,334,800 | B1 | 1/2002 | Nishikawa et al. | 445/7 |
| 6,583,537 | B1 * | 6/2003 | Honda et al. | 313/136 |
| 7,164,225 | B2 | 1/2007 | Yoshimoto et al. | 313/141 |
| 7,365,480 | B2 | 4/2008 | Honda et al. | 313/143 |
| 7,408,294 | B2 | 8/2008 | Okabe et al. | 313/143 |
| 2005/0110381 | A1 * | 5/2005 | Kanao | 313/141 |
| 2005/0242694 | A1 | 11/2005 | Honda et al. | 313/118 |
| 2009/0189505 | A1 * | 7/2009 | Below | 313/143 |

FOREIGN PATENT DOCUMENTS

JP 57017587 1/1982

(Continued)

OTHER PUBLICATIONS

Machine English translation of Jp 2006-066086 to Kanano et al. published Mar. 9, 2006.*

Form PCT/ISA/210—Int'l Search Report (from corresponding Int'l Patent App. No. PCT/JP2009/055683); 2 pages.

(Continued)

*Primary Examiner* — Sikha Roy

(74) *Attorney, Agent, or Firm* — Kusner & Jaffe

(57) ABSTRACT

A spark plug with excellent vibration resistance performance and resistor load life-span characteristics, and a reduced diameter which is achieved by strengthening adhesion between a resistor and a conductive glass sealing layer.

9 Claims, 3 Drawing Sheets

FOREIGN PATENT DOCUMENTS

| | | |
|---|---|---|
| JP | 9063745 | 3/1997 |
| JP | 2001313148 | 11/2001 |
| JP | 2005-327743 | 11/2005 |
| JP | 2005-340171 | 12/2005 |
| JP | 2006066086 | 3/2006 |

OTHER PUBLICATIONS

Notification of Reason for Refusal issued on Aug. 9, 2011 in corresponding Japanese Patent App. No. 2008-090118 (including English translation); 7 pages.

* cited by examiner

SPARK PLUG HAVING IMPROVED ADHESION BETWEEN RESISTOR AND GLASS SEALING LAYER

TECHNICAL FIELD

The present invention relates to a spark plug used for an internal combustion engine, and more particularly, to a spark plug in which a resistor is mounted.

BACKGROUND ART

In general, as a spark plug in which a resistor is mounted, there is one having a structure with a cylindrical insulator body, a through-hole formed inside the insulator along its axial direction, a terminal metal piece made of metal inserted through one end of the through-hole to be fixed thereto, a center electrode made of metal inserted through the other end thereof and fixed, and a resistor disposed between the terminal metal piece and the center electrode in the through-hole (for example, see Japanese Patent Document JP-A-11-339925). The resistor is made of a mixture of glass powder and a conductive material such as carbon black powder or metal powder, however, the metal content is not that high. Accordingly, in many cases, a direct connection between the terminal metal piece made of metal and the center electrode is difficult. Therefore, generally, a configuration has been employed in which a conductive glass sealing layer made of a mixture from glass powder and a relatively large amount of metal powder is provided between them to enhance the joining force.

The spark plug having such a resistor is manufactured as follows.

First, after inserting and fixing the center electrode to the through-hole of the insulator, the conductive glass powder is charged. Thereafter, the raw powder having the resistor composition is charged, the conductive glass power is charged again, and finally, the terminal metal piece is press-fitted from the opposite side to the center electrode, thereby obtaining an assembled unit. Next, the assembled unit is placed in a heating furnace and heated to above a glass softening temperature, and the terminal metal piece is pushed in the axial direction of the terminal metal piece so as to compact each layer. As described above, the conductive glass sealing layer on the resistor and the center electrode side and the conductive glass sealing layer on the terminal metal piece side are obtained. In addition, the terminal metal piece and the center electrode are joined to the resistor with the respective conductive glass sealing layers interposed therebetween and fixed to the insulator (hereinafter, the process for forming the layers is referred to as a "layer formation process").

The spark plug disclosed in Japanese Patent Document JP-A-11-339925 is provided with a metal layer made of a specific material at a surface region of a portion which comes in contact with the conductive glass sealing layer of the terminal metal piece, and by increasing the joining force between the terminal metal piece and the conductive glass sealing layer, problems such as deterioration of the joining state are prevented.

However, recently, in order to achieve an engine design with the ability to allow for high engine power outputs and high engine efficiencies by such means as the increasing of a valve diameter and the free processing a water jacket for more coolant, or in order to save space by reducing the engine itself, a reduction in diameter of the spark plug has been strongly required in terms of vehicle design. In order to realize this, a reduction in diameter of the insulator is inevitable.

However, in order to ensure voltage resistance performance and mechanical strength that are requirements of the insulator, a predetermined radial thickness is needed. Accordingly, the through-hole of the insulator, and in turn, the diameters of the resistor and the conductive glass sealing layer have to be reduced.

However, when the diameter of the through-hole of the insulator is reduced, the sufficient charging of the conductive glass powder is difficult. Moreover, there is a tendency that mechanical strength between the resistor and the conductive glass sealing layer, and particularly, of the joining portion of the resistor and the conductive glass sealing layer is insufficient. Therefore, in some cases, when vibration or an impact is exerted on the spark plug from the engine, exfoliation occurs at the joining surface of the resistor and the conductive glass sealing layer, which does not occur in an existing spark plug where a through-hole has a diameter of about 3.9 mm, so that there are problems with electrical connection.

The spark plug disclosed in Japanese Patent Document JP-A-11-339925 is provided with a metal layer made of a specific material at a surface region of the terminal metal piece and configured to prevent deterioration of a joining state or the separation of the terminal metal piece by increasing the joining force between the terminal metal piece and the conductive glass sealing layer. Therefore, it is associated with a different technique from that of the invention which has an object to reduce the diameter of the spark plug.

In order to solve the above-mentioned problems, it is an object of the invention to provide a spark plug with excellent vibration resistance performance and resistor load life-span characteristics and a reduced diameter which is achieved by strengthening adhesion between a resistor and a conductive glass sealing layer.

SUMMARY OF THE INVENTION

According to the present invention, there is provided:

(1) A spark plug comprising:

a cylindrical metal shell; an insulator which has a through-hole formed inside the insulator along an axial direction of the metal shell and is held in the metal shell so as to be exposed from the metal shell;

a center electrode which is inserted into and fixed to one end portion of the through-hole;

a terminal metal piece which is inserted into and fixed to the other end portion of the through-hole;

a resistor which is provided between the center electrode and the terminal metal piece in the through-hole and distant from the center electrode in the axial direction;

a conductive glass sealing layer which is provided between the resistor and the center electrode in the through-hole without a gap; and a ground electrode which is electrically connected to the metal shell and configured such that a predetermined spark discharge gap is formed between its front end portion and the center electrode, wherein a diameter D of the conductive glass sealing layer is equal to or less than 3.3 mm, and a joining surface of the conductive glass sealing layer and the resistor is a curved surface.

(2) The spark plug according to the above (1), wherein the diameter D of the conductive glass sealing layer is in the range of not less than 1.9 mm and less than 3.0 mm.

(3) The spark plug according to the above (1) or (2), wherein, assuming that a surface area of the joining surface is Sa and an area of a cross-section of the conductive glass sealing layer, which is perpendicular to the axial direction and includes edge portions of the joining surface, is S1, Sa/S1 is equal to or greater than 1.1.

(4) The spark plug according to any one of the above (1) to (3), wherein, assuming that a surface area of the joining surface is Sa and an area of a cross-section of the conductive glass sealing layer, which is perpendicular to the axial direction and includes edge portions of the joining surface, is S1, Sa/S1 is equal to or greater than 1.5.

(5) The spark plug according to any one of the above (1) to (4), wherein a radial cross-section of the through-hole is circular, a distance L in the axial direction between the center electrode and the terminal metal piece is equal to or less than 16 mm, assuming that a maximum diameter of the resistor is DR and a shortest distance in the axial direction of a portion of the resistor which is provided in the through-hole without a gap is M, $DR^2/M$ is equal to or less than 2.2.

(6) The spark plug according to any one of the above (1) to (5), wherein the terminal metal piece and the resistor are distant from each other, the second conductive glass sealing layer is provided between the terminal metal piece and the resistor in the through-hole without a gap, and a second joining surface of the resistor and the second conductive glass sealing layer is a curved surface such that an apex thereof faces the center electrode.

(7) The spark plug according to the above (6), wherein, assuming that a surface area of the second joining surface is Sb and an area of a cross-section of the second conductive glass sealing layer, which is perpendicular to the axial direction and includes edge portions of the second joining surface, is S2, Sb/S2 is equal to or greater than 1.1.

(8) The spark plug according to the above (6) or (7), wherein, assuming that a surface area of the second joining surface is Sb and an area of a cross-section of the second conductive glass sealing layer, which is perpendicular to the axial direction and includes edge portions of the corresponding joining surface, is S2, Sb/S2 is equal to or greater than 1.5.

(9) The spark plug according to any one of the above (1) to (8), wherein the conductive glass sealing layer is formed of a mixture containing glass powder and metal powder, the resistor is formed of a mixture containing glass powder, ceramic powder, and nonmetal conductive powder, and the compositions of the glass powder contained in the conductive glass sealing layer and the glass powder contained in the resistor are different from each other.

(10) The spark plug according to any one of the above (1) to (9), wherein a male thread for mounting, which is formed on the metal shell to be mounted to an opponent member, is equal to or less than M10.

In the configuration (1), the resistor and the center electrode are joined by the conductive glass sealing layer interposed therebetween. Since the diameter D of the conductive glass sealing layer joined to the resistor is equal to or smaller than 3.3 mm ($D \leqq 3.3$ mm) and the joining surface of the resistor is a curved surface, the area of the joining surface of the conductive glass sealing layer and the resistor can be widened even though the diameter D of the conductive glass sealing layer is reduced. Accordingly, the joining force of the joining surface can be increased to be equal to or greater than that in the existing case. Therefore, problems such as exfoliation or connection failure at the joining surface caused by vibration or an impact exerted on the spark plug can be prevented, thereby enhancing reliability of the spark plug. In addition, due to the small diameter of the spark plug, the degree of freedom in engine design can be increased, and a reduction in diameter can be achieved. In addition, the joining surface may have any shape as long as it has a curved surface shape, and for example, a curved surface having a bowl shape, a curved shape having plural convexes and concaves, and a wave-shaped curved surface may be employed.

In the configuration (2), since the diameter D of the conductive glass sealing layer is in the range of not less than 1.9 mm and less than 3.0 mm ($1.9 \text{ mm} \leqq D < 3.0 \text{ mm}$), the diameter of the spark plug can further be reduced. In addition, the degree of freedom in engine design can further be increased, and a reduction in diameter can be achieved.

In the configuration (3), assuming that the surface area of the joining surface of the conductive glass sealing layer and the resistor is Sa and the cross-sectional area of the conductive glass sealing layer is S1, Sa/S1 is equal to or greater than 1.1 (Sa/S1$\geqq$1.1). Therefore, though the diameter D of the conductive glass sealing layer is small, the area of the joining surface of the conductive glass sealing layer and the resistor can be increased, so that the joining force can be increased to be equal to or greater than that in the existing case. In order to further increase the joining force, the configuration (4) may be employed, that is, the configuration in which Sa/S1 is equal to or greater than 1.5 (Sa/S1$\geqq$1.5). Accordingly, problems such as exfoliation and connection failure at the joining portion can be prevented, so that the spark plug having high reliability can be provided.

In the configuration (5), assuming that the maximum diameter of the resistor is DR and the axial shortest length (a portion of the resistor which is provided without a gap) of the resistor is M, $DR^2/M$ is equal to or smaller than 2.2 ($DR^2/M \leqq 2.2$). Therefore, with regard to wave noises that are generally caused by a high voltage spark between electrodes, the generation of the wave noises are suppressed by the resistor, so that an influence of the wave noises on an acoustic device such as a radio or a computer mounted in a vehicle can be suppressed. In addition, since the axial distance L between the center electrode and the terminal metal piece is equal to or smaller than 16 mm ($L \leqq 16$ mm), in the spark plug of which the resistor has a small diameter of 3 mm or less, the influence on the joining surface of the conductive glass sealing layer and the resistor caused by the vibration and the impact of the spark plug can be prevented for a long period of time. Therefore, the spark plug which is small and has a long life-span can be provided.

In the configuration (6), since the second joining surface of the resistor and the second conductive glass sealing layer is a curved surface, the area of the second joining surface of the second conductive glass sealing layer and the resistor can be increased. Accordingly, even when the diameter of the second conductive glass sealing layer is small, the joining force of the second conductive glass sealing layer and the resistor can be increased to be equal to or greater than that in the existing case. Therefore, the problems such as exfoliation and connection failure in the second joining portion caused by the vibration and the impact exerted on the spark plug can be prevented, thereby enhancing the reliability of the spark plug.

In the configuration (7), assuming that the surface area of the second joining surface of the second conductive glass sealing layer and the resistor is Sb and the cross-sectional area of the second conductive glass sealing layer is S2, Sb/S2 is equal to or greater than 1.1 (Sb/S≧1.1). Therefore, even though the diameter of the second conductive glass sealing layer is small, the area of the second joining surface of the second conductive glass sealing layer and the resistor is wide. Accordingly, the joining force at the joining surface can be increased to be equal to or greater than that in the existing case. In order to further increase the joining force, the configuration (8) may be employed, that is, the configuration in which Sb/S2 is equal to or greater than 1.5 (Sb/S≧1.5). Therefore, the problems such as exfoliation and connection failure in the joining portion can be prevented, so that the spark plug having high reliability can be provided.

In the configuration (9), the conductive glass sealing layer is formed from the mixture of glass powder and metal powder, and the resistor is formed from the mixture of glass powder, ceramic powder, and nonmetal conductive powder. In addition, since the compositions of the glass powder contained in the conductive glass sealing layer and the glass powder contained in the resistor are different from each other, the conductive glass sealing layer and the resistor can be strongly joined to each other. Accordingly, the spark plug can be provided which has excellent vibration resistance and impact resistance and a long life-span.

In the configuration (10), since the male thread for mounting which is formed in the metal shell to be mounted to an opponent member such as an engine is equal to or smaller than M10, the effects of the spark plug according to the invention, in which the insulator, the electrode, the resistor, and the conductive glass sealing layer have small diameters, can be significantly exhibited.

Accordingly, the present invention provides a spark plug wherein adhesion between the resistor and the conductive glass sealing layer can be strengthened, so that the spark plug can be provided with excellent vibration resistance performance and resistor load life-span characteristics and a reduced diameter.

DETAILED DESCRIPTION OF PREFERRED EMBODIMENTS

Hereinafter, exemplary embodiments of a spark plug according to the invention will be described with reference to the accompanying drawings.

Figure 1:
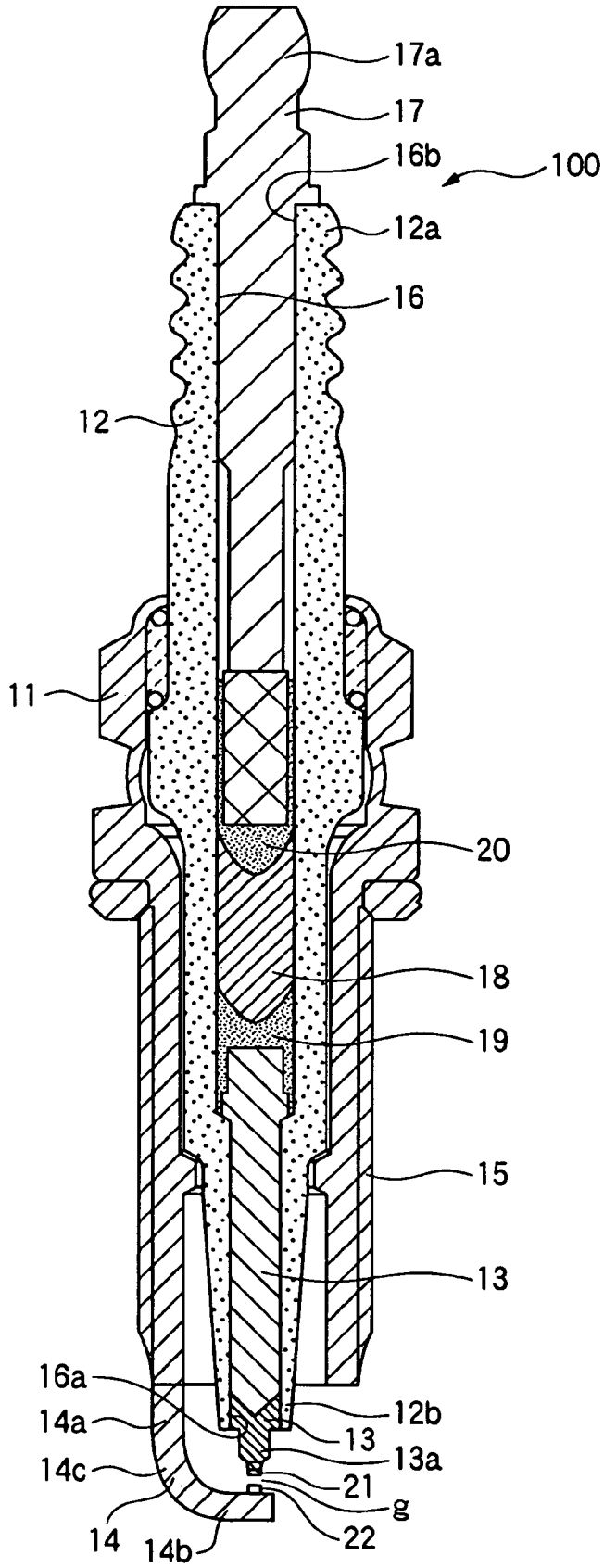
FIG. 1 is a sectional view of a spark plug according to the invention.
Figure 2:
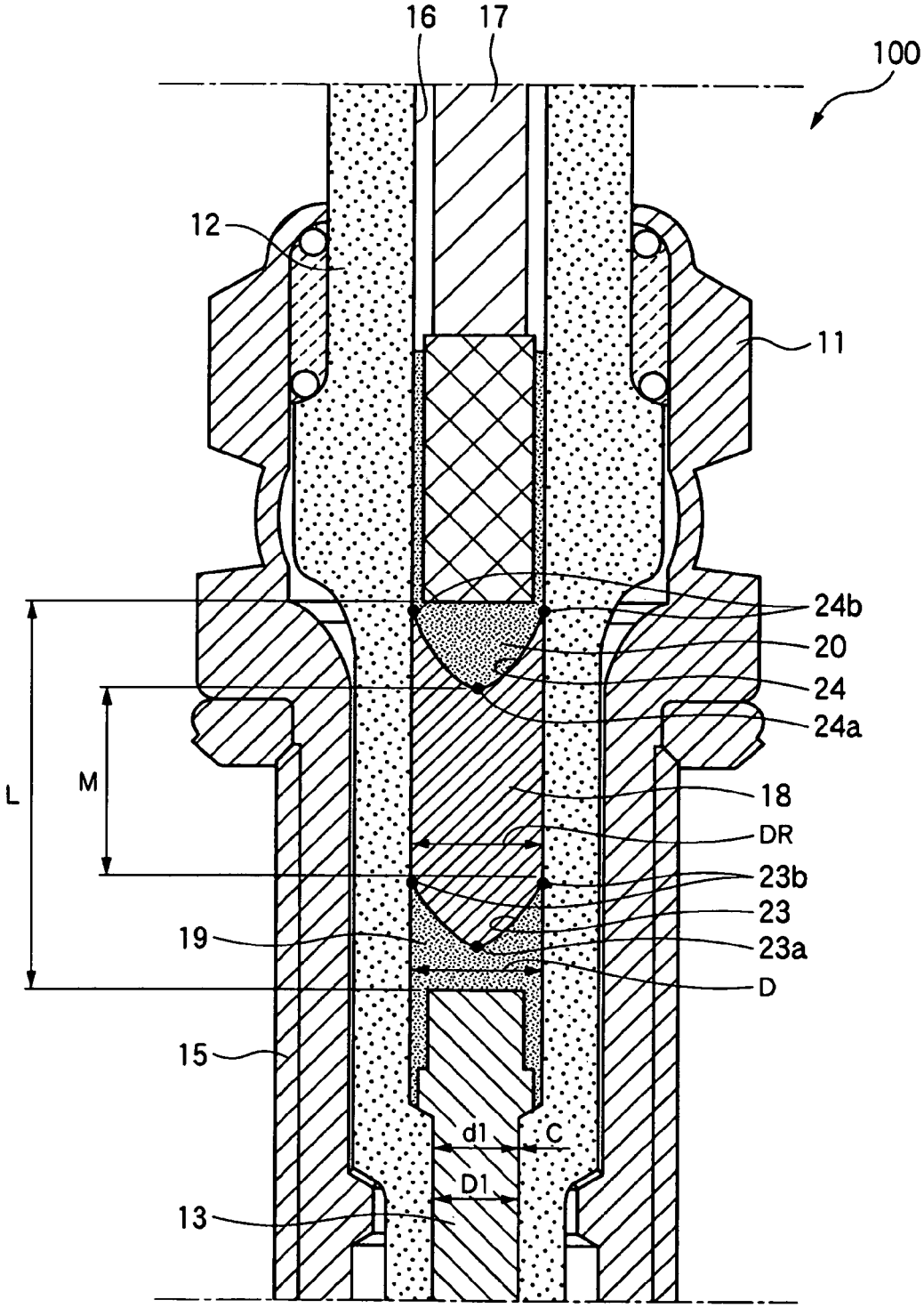
FIG. 2 is an enlarged view of a main section of the spark plug of FIG. 1.

FIG. 1 is a sectional view of a spark plug according to the invention. FIG. 2 is an enlarged view illustrating the main part of the spark plug of FIG. 1.

As illustrated in FIGS. 1 and 2, the spark plug 100 according to the invention includes a cylindrical metal shell 11. An insulator 12 which has a through-hole 16 formed inside the insulator 12 along the axial direction of the metal shell 11 is inserted into the metal shell 11 such that both end portions 12*a* and 12*b* are exposed from the metal shell 11. A center electrode 13 is inserted into and fixed to one end portion 16*a* (the lower side in the figure) of the through-hole 16 such that a front end portion 13*a* thereof is exposed A terminal metal piece 17 is inserted into and fixed to the other end portion 16*b* (the upper side in the figure) of the through-hole 16 such that a rear end portion 17*a* thereof is exposed. A resistor 18 is provided between the center electrode 13 and the terminal metal piece 17 in the through-hole 16. The resistor 18 is distant, i.e., spaced apart, from each of the center electrode 13 and the terminal metal piece 17 in the axial direction. A first conductive glass sealing layer 19 is provided between the resistor 18 and the center electrode 13 in the through-hole 16 without any gap. A second conductive glass sealing layer 20 is provided between the resistor 18 and the terminal metal piece 17 in the through-hole 16 without any gap. A substantially L-shaped ground electrode 14 has one end portion (base portion) 14*a* joined to the metal shell 11 by resistance welding or the like, and has an intermediate portion 14*c* that is bent such that the other, free end portion 14*b* is opposed to the front end portion 13*a* of the center electrode 13.

In the following description, with respect to the axial direction of the metal shell 11, the side on which the center electrode 13 is disposed is referred to as a front side, and the opposite side (the side on which the terminal metal piece is disposed) is referred to as a rear side.

The metal shell 11 is made of carbon steel. A male thread 15 for mounting, which is to be mounted to a cylinder head (opponent member) of an internal combustion engine, is formed on the outer peripheral surface of the metal shell 11 along the peripheral direction. The male thread 15 is set to be equal to or smaller than M10 for a reduction in diameter.

The insulator 12 is formed of a ceramic fired body, such as by way of example and not limitation, alumina.

The through-hole 16 is formed such that radial cross-sections thereof have substantially uniform, circular shapes in the axial direction, and the inside diameter of the through-hole 16 is set to be in the range of 1.9 to 3.3 mm. Accordingly, the diameter D of the first and second conductive glass sealing layers 19 and 20 are set to be in the range of 1.9 to 3.3 mm (that is, 1.9 mm≦D≦3.3 mm).

In addition, the diameter of only a portion of the through-hole 16 on the front side is reduced to form a stepped portion (in the figure, the inside diameter of this portion is denoted by d1 (see FIG. 2)).

In addition, since the resistor 18 is disposed between the terminal metal piece 17 and the center electrode 13 in the through-hole 16 and the first and the second conductive glass sealing layers 19 and 20 are disposed at both end portions of the resistor 18, the resistor 18 is electrically connected to the center electrode 13 and the terminal metal piece 17 with the first and the second conductive glass sealing layers 19 and 20. The conductive glass sealing layers 19 and 20 and the resistor 18 form a conductive bonding layer, and the composition or the like thereof will be described layer.

The center electrode 13 is made from a Ni alloy having excellent heat and corrosion resistance such as Inconel (Inconel: trade name) and is formed into a columnar shape. In addition, a precious metal tip 21, which is made from, for example, an alloy (Ir-5Pt) containing iridium as a main component and 5 mass % of platinum and is formed into a columnar shape, is joined to the front end of the center electrode 13 by laser welding or the like. The inside diameter d1 (inside diameter of the portion having the reduced diameter) of the through-hole 16 of the insulator 12 is slightly greater than the outside diameter D1 of the center electrode 13, and a radial gap C of, for example, 0.1 to 0.5 mm is formed between the center electrode 13 and the through-hole 16. The radial gap C is provided as a gap for avoiding a difference between the thermal expansion amounts caused by different thermal expansion coefficients of the center electrode 13 and the insulator 12.

The ground electrode 14 is made from a Ni alloy having excellent heat and corrosion resistance and is formed into a substantially prismatic shape. In addition, a column-shaped precious metal tip 22, which is made of a Pt alloy containing, for example, platinum as a main component and Rh or Ir as a sub component, is joined by laser welding or the like at a position opposed to the precious metal tip 21 of the center electrode 13. Because the base portion 14*a* of the ground electrode 14 is joined to the metal shell 11, the metal shell 11 and the ground electrode 14 are electrically connected to each other.

Accordingly, a spark discharge gap g is formed between the precious metal tip 21 of the center electrode 13 and the precious metal tip 22 of the ground electrode 14 in the axial direction. The size of the spark discharge gap g is set to, for example, about 0.9 mm. By applying a high voltage between the ground electrode 14 and the center electrode 13 in this state, spark discharge is generated in the spark discharge gap g so as to allow the spark plug 100 according to the invention to function as an ignition source of an internal combustion engine.

The terminal metal piece 17 is made from, for example, low carbon steel, and a Ni-based metal layer is coated on the surface thereof by plating or the like. The axial distance L between the terminal metal piece 17 and the center electrode 13 is set to be equal to or smaller than 16 mm ($L \leqq 16$ mm).

The resistor 18 is formed by sintering predetermined amounts of glass powder, ceramic powder, nonmetal conductive powder, and the like using, for example, the above-mentioned layer formation process. The resistance thereof is, for example, substantially 5 kΩ.

As the glass powder, borosilicate glass obtained by suitably combining $SiO_2$, $B_2O_5$, $Na_2O$, BaO, and the like is exemplified. As the ceramic powder, $ZrO_2$ is exemplified. As the nonmetal conductive powder, carbon black or graphite is exemplified. In addition, powder of metal such as Zn, Sb, Sn, Ag, and Ni, an organic binder such as dextrin, or the like may be contained.

The first and the second conductive glass sealing layers 19 and 20 are formed by combining a predetermined amount of metal powder containing one or more kinds of metal components such as Cu and Fe and a predetermined amount of glass powder such as the borosilicate glass and sintering them by, for example, the above-mentioned layer formation process. In addition, as needed, a suitable amount of semi-conductive inorganic compound powder such as $TiO_2$ may be added.

Here, for strong junctions of the resistor 18 and the conductive glass sealing layer 19 and 20, the compositions of the glass powder contained in the resistor 18 and the conductive glass sealing layers 19 and 20 may be different from each other.

The first and the second conductive glass sealing layers 19 and 20 are heated to above a glass softening temperature and charged in the gap between the center electrode 13 and the through-hole 16 and the gap between the terminal metal piece 17 and the through-hole 16 as the terminal metal piece 17 is pushed and inserted in the axial direction so as to fill and seal the gap. In addition, the first conductive glass sealing layer 19 in this case is joined to the center electrode 13 and the resistor 18, and likewise, the second conductive glass sealing layer 20 is joined to the resistor 18 and the terminal metal piece 17.

The diameter D of the first conductive glass sealing layer 19 is set to be in the range of 1.9 to 3.3 mm ($1.9 \text{ mm} \leqq D \leqq 3.3$ mm), and more preferably, in the range of not less than 1.9 mm and less than 3.0 mm ($1.9 \text{ mm} \leqq D \leqq 3.0$ mm).

A joining surface 23 of the first conductive glass sealing layer 19 and the resistor 18 has a bowl shape (curved surface shape) in which an apex 23*a* thereof faces the center electrode 13. Assuming that the surface area of the joining surface 23 is Sa and the cross-sectional area (a cross-section that is perpendicular to the axial direction and includes edge portions 23*b* of the joining surface 23) of the first conductive glass sealing layer 19 is S1, the above-mentioned materials are charged and compacted such that Sa/S1 is equal to or greater than 1.1 ($Sa/S1 \geqq 1.1$).

In addition, it is more preferable that Sa/S1 is equal to or greater than 1.5 ($Sa/S1 \geqq 1.5$).

As described above, by forming the joining surface 23 of the first conductive glass sealing layer 19 and the resistor 18 into the bowl shape, the area of the joining surface 23 of the first conductive glass sealing layer 19 and the resistor 18 can be widened, i.e., increased, even though the diameter D of the first conductive glass sealing layer 19 is reduced. Accordingly, the joining force between the first conductive glass sealing layer 19 and the resistor 18 at the joining surface 23 can be increased to be equal to or greater than that in the existing case. Therefore, problems such as exfoliation or connection failure at the joining surface 23 caused by vibration or an impact exerted on the spark plug 100 can be prevented, thereby enhancing reliability of the spark plug 100.

Here, since the small gap C of, for example, about 0.1 to 0.5 mm exists between the through-hole 16 and the center electrode 13, there is a concern that the center electrode 13 vibrates relative to the insulator 12 when vibration or an impact is transferred to the spark plug 100 from the engine or the like. However, in this embodiment, the center electrode 13 is joined to the resistor 18 with the first conductive glass sealing layer 19 over the large area Sa, that is, by the large joining force, so that the generation of exfoliation at the joining surface 23 can be prevented.

A joining surface 24 of the second conductive glass sealing layer 20 and the resistor 18 also has a bowl shape (curved surface shape) in which an apex 24*a* thereof faces the center electrode 13 like that of the first conductive glass sealing layer 19. Assuming that the surface area of the joining surface 24 is Sb and the cross-sectional area (a cross-section that is perpendicular to the axial direction and includes edge portions 24*b* of the joining surface 24) of the second conductive glass sealing layer 20 is S2, the above-mentioned materials are charged and compacted such that Sb/S2 is equal to or greater than 1.1 ($Sb/S2 \geqq 1.1$).

In addition, it is more preferable that Sb/S2 is equal to or greater than 1.5 ($Sb/S2 \geqq 1.5$).

As described above, by forming the joining surface 24 of the second conductive glass sealing layer 20 and the resistor 18 into the bowl shape, the area of the joining surface 24 of the second conductive glass sealing layer 20 and the resistor 18 can be widened, i.e., increased, although the diameter of the second conductive glass sealing layer 20 is reduced. Accordingly, the joining force between the second conductive glass sealing layer 20 and the resistor 18 at the joining surface 24 can be increased to be equal to or greater than that in the existing case. Therefore, problems such as exfoliation or connection failure at the joining surface 24 can be prevented, so that the spark plug 100 with high reliability can be provided.

In addition, the second conductive glass sealing layer 20 is distant from the center electrode 13 on which vibration or an impact is directly exerted, and vibration or the impact exerted on the joining surface 24 of the second conductive glass sealing layer 20 and the resistor 18 is not greater than the first joining surface 23. Accordingly, as it is set to Sb/S2≧1.1 (preferably, Sb/S2≧1.5) that is the same area ratio as that of the first joining surface 23, the generation of exfoliation at the joining surface 24 can be reliably prevented.

In addition, assuming that the shortest length of the resistor 18 (the axial length of only the portion of the resistor 18 which is provided in the through-hole 16 without a gap, that is, the shortest axial distance from the edge portion 23*b* of the joining surface 23 and the apex 24*a* of the joining surface 24 in the figure) in the axial direction is M and the maximum diameter (diameter) of the resistor 18 is DR, $DR^2/M$ is equal to or smaller than 2.2 ($DR^2/M \leqq 2.2$).

This is because it has been analyzed and found by the inventors that with regard to wave noises that are generally caused by a high voltage spark between electrodes, the generation of the wave noises are suppressed by the resistor 18 when the relationship of $DR^2/M \leqq 2.2$ is satisfied. Accordingly, by employing the spark plug 100 according to the invention, an influence of wave noises on an acoustic device such as a radio or a computer mounted in a vehicle can be prevented.

In addition, in this embodiment illustrated in FIG. 2, since DR=D, $D^2/M \leqq 2.2$.

EXAMPLE

Next, the numerical ranges of the diameter D of the above-mentioned first conductive glass sealing layer 19, the surface area Sa of the joining surface 23 of the first conductive glass sealing layer 19 and the resistor 18, and the axial distance L between the center electrode 13 and the terminal metal piece 17 will be described in further detail with reference to the drawings and tables showing results of evaluation tests.

Figure 3:
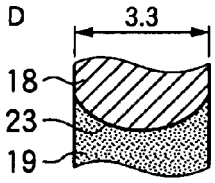
FIG. 3 is a conceptual view showing the comparison between values of Sa/S1 obtained by using the surface area Sa and the cross-sectional area S1 of a joining surface when the diameter of a conductive glass sealing layer and the shape of the joining surface are changed.
Figure 3:
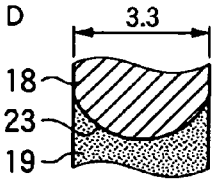
Figure 3:
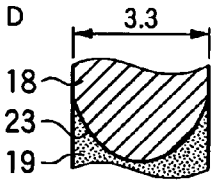
Figure 3:
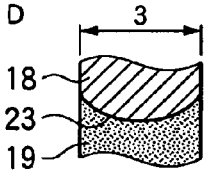
Figure 3:
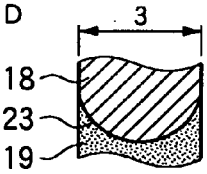
Figure 3:
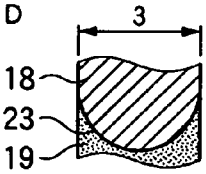
Figure 3:
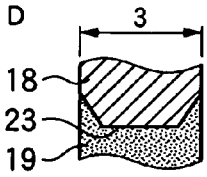
Figure 3:
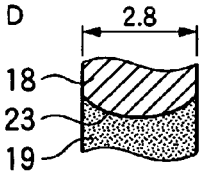
Figure 3:
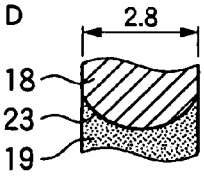
Figure 3:
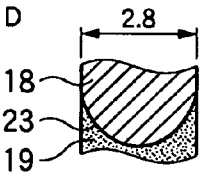
Figure 3:
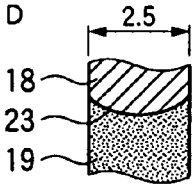
Figure 3:
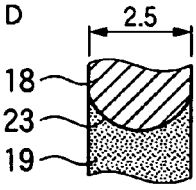
Figure 3:
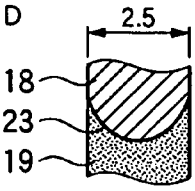
Figure 3:
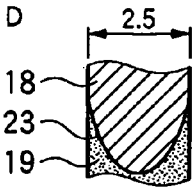

FIG. 3 shows the comparison of the surface areas Sa of the joining surface 23 and the values Sa/S1 when the diameter D of the first conductive glass sealing layer and the shape of the joining surface 23 are changed.

In addition, the diameter D of the conductive glass sealing layer shown in FIGS. 3(*a*) to 3(*n*) is 3.3, 3.0, 2.8, and 2.5 mm, and it can be seen that as the concave depth of the bowl shape of the joining surface 23 increases, the surface area Sa of the joining surface 23 increases. In addition, the shape of the joining surface 23 is not limited to the bowl shape as long as the shape increases the surface area Sa of the joining surface 23, and as shown in FIG. 3(*g*), a conical trapezoidal shape may be effective. Otherwise, a curved surface having plural convexes and concaves not shown or a wave-shaped curved surface may be employed. In addition, in FIG. 3, the shape of the joining surface 23 is shown, however, this can also be applied to the surface area Sb of the joining surface 24.

Hereinafter, the evaluation test will be explained.

Plural samples of the spark plug were manufactured by changing the diameter D of the first conductive glass sealing layer 19 in the range of 1.5 to 3.9 mm, and changing the value (Sa/S1) obtained by the surface area Sa of the joining surface 23 of the first conductive glass sealing layer 19 and the resistor 18 and the cross-sectional area S1 in the range of 1.02 to 3.00.

On the basis of the impact resistance test specified in HS B8031:2006 (Internal combustion engines-Spark plugs), the evaluation test was performed on the samples of the spark plug under conditions of a vibration amplitude of 22 mm, a number of times of impact of 400 times/min for one to two hours (although 10 minutes in JIS standard, a severe test was performed by setting more strict conditions).

In addition, after the impact resistance test, on the basis of a resistor load life-span test specified in JIS B8031:2006, a high voltage of 20±5 kV was applied to generate sparks $1.3\times10^7$ times, and after being left for an hour, a change in resistance was measured.

The axial distance L between the terminal metal piece 17 and the center electrode 13 was uniformly set to 11 mm. In addition, the diameter of D=3.9 mm is the same diameter as that of the existing spark plug, and the same test was performed thereon for comparison with the invention.

After the impact resistance test performed for one hour, the result of the evaluation test for changes in resistance of the samples of the spark plug on which the resistor load life-span test was performed is shown in Table 1. After the impact resistance test performed for two hours, the result of the evaluation test for changes in resistance of the samples of the spark plug on which the resistor load life-span test was performed is shown in Table 2.

TABLE 1

| | Sealing layer diameter D[mm] | | | | | | | | | | |
|---|---|---|---|---|---|---|---|---|---|---|---|
| | 3.9 | 3.3 | 2.9 | 2.7 | 2.5 | 2.3 | 2.1 | 2.0 | 1.9 | 1.8 | 1.5 |
| | Sealing layer cross-section Sa[mm] | | | | | | | | | | |
| Sa/S1 | 11.95 | 8.55 | 6.61 | 5.73 | 4.91 | 4.15 | 3.46 | 3.14 | 2.84 | 2.54 | 1.77 |
| 1.02 | A | B | C | C | C | C | C | C | C | C | D |
| 1.05 | A | B | C | C | C | C | C | C | C | C | D |
| 1.10 | A | A | A | A | A | A | A | A | A | B | C |
| 1.30 | A | A | A | A | A | A | A | A | A | B | C |
| 1.50 | A | A | A | A | A | A | A | A | A | B | C |
| 1.80 | A | A | A | A | A | A | A | A | A | B | C |
| 2.10 | A | A | A | A | A | A | A | A | A | B | C |
| 2.40 | A | A | A | A | A | A | A | A | A | B | C |
| 2.70 | A | A | A | A | A | A | A | A | A | B | C |
| 3.00 | A | A | A | A | A | A | A | A | A | B | C |

TABLE 2

| | Sealing layer diameter D[mm] | | | | | | | | | | |
|---|---|---|---|---|---|---|---|---|---|---|---|
| | 3.9 | 3.3 | 2.9 | 2.7 | 2.5 | 2.3 | 2.1 | 2.0 | 1.9 | 1.8 | 1.5 |
| | Sealing layer cross-section Sa[mm] | | | | | | | | | | |
| Sa/S1 | 11.95 | 8.55 | 6.61 | 5.73 | 4.91 | 4.15 | 3.46 | 3.14 | 2.84 | 2.54 | 1.77 |
| 1.02 | A | C | C | C | C | C | C | C | C | C | D |
| 1.05 | A | C | C | C | C | C | C | C | C | C | D |
| 1.10 | A | B | C | C | C | C | C | C | C | C | D |
| 1.30 | A | B | C | C | C | C | C | C | C | C | D |
| 1.50 | A | A | A | A | A | A | A | A | A | B | C |
| 1.80 | A | A | A | A | A | A | A | A | A | B | C |
| 2.10 | A | A | A | A | A | A | A | A | A | B | C |
| 2.40 | A | A | A | A | A | A | A | A | A | B | C |
| 2.70 | A | A | A | A | A | A | A | A | A | B | C |
| 3.00 | A | A | A | A | A | A | A | A | A | B | C |

Here, after the test, those having a change in resistance of ±15% or less were evaluated as A, those having ±25% or less were evaluated as B, those having ±30% or less were evaluated as C, and those having ±30% or greater were evaluated as D.

In addition, in JIS B8031:2006, it is specified that the change in resistance after the impact resistance test is ±10% or less, and the change in resistance after the resistor load life-span test is ±30% or less. In addition, this test was performed under more severe conditions than that of HS B8031:2006, so that those evaluated as C or D in this test do not have problems with product quality.

As shown in Table 1, as a result of the impact resistance test and the resistor load life-span test performed for one hour, the samples of the spark plug which have the diameters of D=1.8 mm and 1.5 mm and Sa/S1=1.02 and 1.05 showed large changes in resistance, however, the changes in resistance of other samples of the spark plug were ±15% or less, which is positive. From the result, it can be seen that when the diameter D is in the range of 1.9 to 3.3 mm (1.9 mm≦D≦3.3 mm) and Sa/S1 is equal to or greater than 1.1 (Sa/S1≧1.1), a positive result that can achieve the object (to strengthen the joining force with a reduction in diameter) of the invention could be obtained.

In addition, since the diameter of D=3.9 mm is the same diameter as that of the existing spark plug, it was excluded from the scope of the invention as the invention has the object is to reduce the diameter.

In addition, as shown in Table 2, as a result of the impact resistance test and the resistor load life-span test performed for two hours, large changes in resistance were observed in the samples of the spark plug having the diameter of D=1.8 mm and 1.5 mm and Sa/S1=1.30 or less, however, the changes in resistance of other samples of the spark plug were ±15%, which is positive. From the result, it can be seen that when the diameter D is in the range of not less than 1.9 and less than 3.0 mm (1.9 mm≦D≦3.0 mm) and Sa/S1 is equal to or greater than 1.5 (Sa/S1≧1.5), a positive result that can further achieve the object (to strengthen the joining force with a reduction in diameter) of the invention could be obtained.

In addition, the existing spark plug having the diameter of D=3.9 mm which was tested for comparison could obtain the result without any problem in any evaluation test.

On the basis of the experimental results of Tables 1 and 2, after performing the impact resistance test for two hours on the basis of JIS B8031:2006 by reducing the diameter to a diameter of D=2.9 mm, changing the axial distance L between the terminal metal piece 17 and the center electrode 13 to be in the range of 4 to 22 mm, changing the value (Sa/S1) that is based on the surface area Sa and the cross-sectional area 51 of the joining surface 23 of the first conductive glass sealing layer 19 and the resistor 18 to be in the range of 1.5 to 3.00, the resistor load life-span test was performed. The measurement result of the change in resistance after this test is shown in Table 3.

In addition, the same evaluation reference as those of Tables 1 and 2 is applied. Even in this case, the evaluation test was performed by setting more severe conditions as compared with JIS B8031:2006. Accordingly, in this test, those evaluated as C or D do not have problems with product quality.

TABLE 3

| | Sa/S1 | | | | | | |
|---|---|---|---|---|---|---|---|
| L | 1.5 | 1.8 | 2.1 | 2.4 | 2.1 | 2.7 | 3.0 |
| 4 | A | A | A | A | A | A | A |
| 6 | A | A | A | A | A | A | A |
| 8 | A | A | A | A | A | A | A |
| 10 | A | A | A | A | A | A | A |
| 12 | A | A | A | A | A | A | A |
| 14 | A | A | A | A | A | A | A |
| 16 | A | A | A | A | A | A | A |
| 18 | C | C | B | B | B | B | C |
| 20 | C | C | C | C | C | C | C |
| 22 | C | C | C | C | C | C | C |

As shown in Table 3, when the axial distance L between the terminal metal piece 17 and the center electrode 13 is greater than 18 mm, a large change in resistance could be shown. However, when the axial distance L is equal to or less than 16 mm, the change in resistance was ±15%, which is positive. It is thought that when the axial distance L between the terminal metal piece 17 and the center electrode 13 increases, the raw powder (glass powder, ceramic powder, nonmetal conductive powder, and the like) with the resistor composition or the raw powder (glass powder, metal powder, and the like) of the conductive glass sealing layer cannot be sufficiently densified. From the result, the axial distance L between the terminal metal piece 17 and the center electrode 13 was set to be equal to or less than 16 mm.

In addition, it is needless to say that the result of the evaluation test described above can be applied to the diameter of the second conductive glass sealing layer 20 and the surface area Sb of the joining surface 24.

In addition, assuming that the axial length of the resistor 18 (the axial distance from the edge portion 23*b* of the joining surface 23 and the apex 24*a* of the joining surface 24) is M and the diameter of the resistor 18 is DR the numerical range of the value $DR^2/M$ will be described in further detail with reference to the tables showing results of evaluation tests.

Hereinafter, the evaluation test will be explained.

Plural samples of the spark plug were manufactured by changing the diameter DR of the resistor 18, that is, the diameter D of the first conductive glass sealing layer 19 to 2.0, 2.5, and 3.3 and changing (refer to Table 4) the axial length M of the resistor 18 for each diameter. An evaluation test was performed on the samples of the spark plug on the basis of the current method specified in JASO:D002-2:2004.

The result of the evaluation test is shown in Table 4.

TABLE 4

| D | M | $D^2/M$ | Evaluation |
|---|---|---|---|
| 3.3 | 4.6 | 2.37 | B |
| 3.3 | 4.3 | 2.53 | B |
| 3.3 | 5 | 2.18 | A |
| 3.3 | 5.2 | 2.09 | A |
| 3.3 | 5.5 | 1.98 | A |
| 2.5 | 2 | 3.13 | B |
| 2.5 | 2.5 | 2.50 | B |
| 2.5 | 2.9 | 2.16 | A |
| 2.5 | 3 | 2.08 | A |
| 2.5 | 3.2 | 1.95 | A |
| 2.0 | 1.5 | 2.67 | B |
| 2.0 | 1.7 | 2.35 | B |
| 2.0 | 1.9 | 2.11 | A |
| 2.0 | 2.1 | 1.90 | A |

Here, at 500 MHz which was influenced by electrostatic capacitance, those having attenuations of equal to or greater than that of existing products (D=3.9, M=6.9 mm, $D^2/M$=2.2, resistance of 5 kΩ) used as comparative examples were evaluated as A and those having smaller attenuations than existing products were evaluated as B.

As shown in Table 4, when $D^2/M$ was greater than 2.2, the attenuation was small. However, when $D^2/M$ was equal to or smaller than 2.2, the attenuation was positive. From the result, $D^2/M$ was set to be equal to or less than 2.2. In this case, it can be seen that with regard to wave noises that are generally caused by a high voltage spark between electrodes, the generation of the wave noises are suppressed by the resistor, so that an influence of the wave noises on an acoustic device such as a radio or a computer mounted in a vehicle can be suppressed.

As described above, in the spark plug 100 according to this embodiment, adhesion between the resistor 18 and the conductive glass sealing layers 19 and 20 can be strengthened, so that a spark plug 100 can be achieved with excellent vibration resistance performance and resistor load life-span characteristics and a reduced diameter. Accordingly, even though it has a small diameter, the spark plug 100 can be provided which has better performance than the existing product having a large diameter and can be used with high reliability in tough environments where vibration, high temperature, or the like is exerted.

The invention is not limited to the above-mentioned embodiments and can be suitably modified and improved.

While the invention has been described in detail with reference to the embodiments, it should be understood by those skilled in the art that various alternations and modifications can be made without departing from the sprit and scope of the invention.

Priority is claimed on Japanese Patent Application No. 2008-090118, filed on Mar. 31, 2008, the contents of which are incorporated herein by reference.

The invention claimed is:

1. A spark plug comprising:

a cylindrical metal shell;

an insulator which has a through-hole formed inside the insulator along an axial direction of the metal shell and is held in the metal shell so as to be exposed from the metal shell;

a center electrode which is inserted into and fixed to one end portion of the through-hole;

a terminal metal piece which is inserted into and fixed to the other end portion of the through-hole;

a resistor which is provided between the center electrode and the terminal metal piece in the through-hole and distant from the center electrode in the axial direction;

a conductive glass sealing layer which is provided between the resistor and the center electrode in the through-hole without a gap; and a ground electrode which is electrically connected to the metal shell and configured such that a predetermined spark discharge gap is formed between its front end portion and the center electrode, wherein a diameter D of the conductive glass sealing layer is equal to or less than 3.3 mm, a joining surface of the conductive glass sealing layer and the resistor is a curved surface, an assuming that a surface area of the joining surface is Sa and an area of a cross-section of the conductive glass sealing layer, which is perpendicular to the axial direction and includes edge portions of the joining surface, is S1, Sa/S1 is equal to or greater than 1.1 and equal to or smaller than 3.0.

2. The spark plug according to claim 1, wherein the diameter D of the conductive glass sealing layer is in the range of not less than 1.9 mm and less than 3.0 mm.

3. The spark plug according to claim 1, wherein, assuming that a surface area of the joining surface is Sa and an area of a cross-section of the conductive glass sealing layer, which is perpendicular to the axial direction and includes edge portions of the joining surface, is S1, Sa/S1 is equal to or greater than 1.5.

4. A spark plug according to claim 1, wherein a radial cross-section of the through-hole is circular, a distance L in the axial direction between the center electrode and the terminal metal piece is equal to or less than 16 mm, and assuming that a maximum diameter of the resistor is DR and a shortest distance in the axial direction of a portion of the resistor which is provided in the through-hole without a gap is M, $DR^2/M$ is equal to or less than 2.2.

5. The spark plug according to claim 1 or 4, wherein the terminal metal piece and the resistor are distant from each other, the second conductive glass sealing layer is provided between the terminal metal piece and the resistor in the through-hole without a gap, and a second joining surface of the resistor and the second conductive glass sealing layer is a curved surface such that an apex thereof faces the center electrode.

6. The spark plug according to claim 5, wherein, assuming that a surface area of the second joining surface is Sb and an area of a cross-section of the second conductive glass sealing layer, which is perpendicular to the axial direction and includes edge portions of the second joining surface, is S2, Sb/S2 is equal to or greater than 1.1.

7. The spark plug according to claim 5, wherein, assuming that a surface area of the second joining surface is Sb and an area of a cross-section of the second conductive glass sealing layer, which is perpendicular to the axial direction and includes edge portions of the corresponding joining surface, is S2, Sb/S2 is equal to or greater than 1.5.

8. The spark plug according to claim 1 or 4, wherein the conductive glass sealing layer is formed of a mixture containing glass powder and metal powder, the resistor is formed of a mixture containing glass powder, ceramic powder, and nonmetal conductive powder.

9. The spark plug according to claim 1 or 4, wherein a male thread for mounting, which is formed on the metal shell to be mounted to an opponent member, is equal to or less than M10.

* * * * *